United States Patent [19]

Kroeger et al.

[11] Patent Number: 4,747,143

[45] Date of Patent: May 24, 1988

[54] SPEECH ENHANCEMENT SYSTEM HAVING DYNAMIC GAIN CONTROL

[75] Inventors: Brian W. Kroeger, Ellicott City; John J. Kurtz, Catonsville, both of Md.

[73] Assignee: Westinghouse Electric Corp., Pittsburgh, Pa.

[21] Appl. No.: 755,235

[22] Filed: Jul. 12, 1985

[51] Int. Cl.[4] ..... G10L 5/00

[52] U.S. Cl. ..... 381/47; 330/136; 455/245

[58] Field of Search ..... 381/46, 47, 104–108, 381/94; 455/218–222, 246, 247, 245, 234; 379/421; 330/134, 279, 132, 136

[56] References Cited

U.S. PATENT DOCUMENTS 3,989,897 11/1976 Carver ..... 381/47

4,028,496 6/1977 La Marche et al. ..... 381/46

*Primary Examiner*—E. S. Kemeny

*Attorney, Agent, or Firm*—W. G. Sutcliff

[57] ABSTRACT

An arrangement for a speech enhancement processor which maintains the processed speech at a constant level regardless of large changes in the associated noise level. The composite speech and noise signal is applied to a first AGC circuit and then to a speech enhancement system which removes tonal, impulse, and wideband noises from the signal. The extracted noise power estimates are subtracted from the constant amplitude signal to provide a gain control signal value to which the gain of a second variable gain amplifier is inversely proportional. The amplifier multiplies the processed speech output from the enhancement system and, because of the variable gain control, provides an output speech signal having short-term amplitude levels which correspond to those of the input speech signal, and having a constant long-term amplitude level.

12 Claims, 1 Drawing Sheet

SPEECH ENHANCEMENT SYSTEM HAVING DYNAMIC GAIN CONTROL

BACKGROUND OF THE INVENTION

This invention relates, in general, to electronic speech enhancement systems and, more specifically, to dynamic gain control of voice signals.

In a variety of applications, it is desirable to receive and understand voice or speech communication signals in the presence of audio interference. Such speech signals may be derived directly from radio receivers, recordings, intercoms, or other sources of audio signals. The interference associated with the speech depends to some extent upon the nature of the speed signal and the environment from which it originated. Experience has shown that it is desirable to eliminate at least three types of noise interference signals when the speech-to-noise ratio is relatively low. It is desirable to eliminate tonal noises, which correspond to continuous and repetitive tone noises, such as engine whine and 60 Hz AC power hum. It is also desirable to eliminate impulse noises in the speech enhancement system which could originate, in this example, due to communication jamming signals or to local electromagnetic signal interference at the receiving site. A third type of noise, wideband noise, is often present when the signal is extremely weak and eliminating such noise by the speech enhancement system is highly desirable.

Modern state of the art speech enhancement systems usually operate in a digital mode wherein the analog speech signals are first converted into digital values by a sampling technique before being processed. Due to the inherent features of a digital system, it is desirable to maintain the signals applied thereto within a specified range of digital values. Applying a digital value too large may saturate the digital system, thereby adding distortion to the speech. Applying a digital value which is too small to the digital system lowers the resolution capabilities and quantization noise detracts from the performance of the speech processor. To alleviate this situation, it has been standard practice according to the prior art to apply the incoming, unenhanced speech signal to an automatic gain control (AGC) circuit which provides a relatively constant signal level for use by the speech enhancement system. However, since in many situations the noise energy present in a speech plus noise signal is many times greater than the speech contained within the signal, and since an AGC circuit responds to the total or composite signal, the amount of speech signal present in the constant output varies and is a function of the variation in the noise component of the input signal. For this reason, the voice signal remaining after the speech enhancement system removes the noise components from the signal processed by an AGC circuit, varies in amplitude and is not as desirable as a speech signal having a nearly constant level arranged over time where short time fluctuations correspond to the original speech amplitude fluctuations before being processed.

Therefore, it is desirable, and it is an object of this invention, to provide a speech enhancement system whereby the speech or voice signals provided at the output of the system have an amplitude more representative of the input speech amplitude than conventional prior art systems while keeping the speech signal averaged over time at nearly a constant level.

SUMMARY OF THE INVENTION

There is disclosed herein a new and useful speech enhancement system for maintaining the amplitude characteristics of the processed speech signal. The system includes an automatic gain control (AGC) circuit to which the composite or total voice or speech plus noise signal is applied. The AGC processed composite signal is then applied to a speech enhancement processor which determines the short-time averages of the tonal noise, impulse noise, and wideband noise powers existing in the composite voice plus noise signal. According to the processing technique, these noise powers are removed from the composite signal thereby providing a speech signal absent most of the noise present before processing. The three noise power signal estimates or values are also subtracted from the AGC processed constant amplitude value to form a gain control signal which, in effect, varies according to the instantaneous signal applied to the processing system. The speech signal from the processing system is applied to a variable gain amplifier whose gain is controlled by the gain control signal. The gain is controlled such that the gain is an inverse function of the gain control signal, with a higher value of the gain control signal providing a lower gain of the variable gain amplifier. This provides an overall gain equal to a constant divided by the gain control signal and results in the output of a speech or voice signal which is constant over the long-term average and the gain is adjusted to compensate for the short-term fluctuations in the voice level due to short-term changes in the noise level.

BRIEF DESCRIPTION OF THE DRAWING

Further advantages and uses of this invention will become more apparent when considered in view of the following detailed description and drawing, in which.

DESCRIPTION OF THE PREFERRED EMBODIMENTS

Figure 1A:
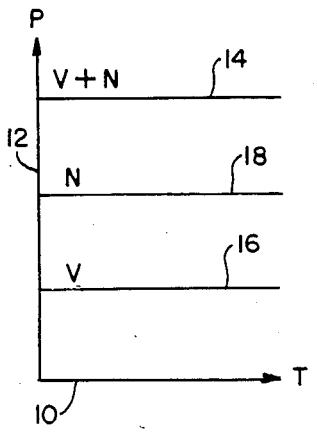
FIG. 1A is a graph illustrating input signal levels before AGC action.

Throughout the following description, similar reference characters refer to similar elements or members in all of the figures of the drawing.

Referring now to the drawings, and to FIG. 1A in particular, there is shown a graph illustrating the relationship of the signal components of a composite input signal. Since the components can vary in relation to each other with time, axis 10 corresponds to time and axis 12 corresponds to the short-term power level of the signal. The composite voice plus noise input signal is shown by line 14. It remains constant throughout the period of time illustrated in FIG. 1A. The composite or total signal level 14 includes the voice signal level and the total noise signal level, each represented separately by lines 16 and 18, respectively. As can be seen from FIG. 1A, the signal level or line 14 is a total of signal levels 16 and 18. FIG. 1A represents the signal level which would be applied to the input of an automatic gain control (AGC) circuit.

A "short-term" for voice signals amounts to approximately a few seconds and is primarily the minimum time neccesary to preserve the original modulation characteristics and the silence between words. Periods of time longer than short-term, such as, for example, longer than approximately three seconds, is considered "long-term" for the purposes of this invention.

Figure 1B:
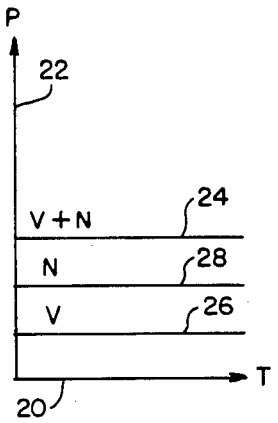
FIG. 1B is a graph illustrating signal levels afer AGC action on an input signal.
Figure 1C:
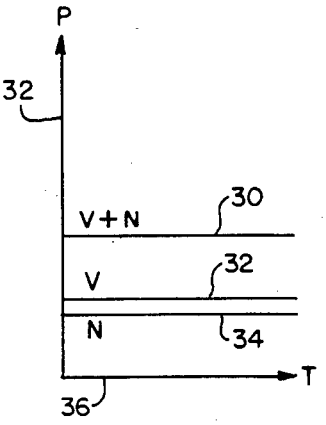
FIG. 1C is a graph illustrating signal levels after AGC action on another input signal.

After processing by an AGC circuit, the signal levels illustrated in FIG. 1A could be represented by the signal levels shown in FIG. 1B. In FIG. 1B, axis 20 corresponds to time and axis 22 corresponds to power level. The composite signal level or line 24 represents the voice plus noise signals illustrated separately by lines 26 and 28, respectively. By comparing FIGS. 1A and 1B, it can be sen that the relationship btween the noise and voice signal levels before and after AGC action remains the same. However, the AGC circuit functions to maintain the composite signal level, such as signal 24, at a constant amplitude regardless of the respective amplitudes of its component signals. Therefore, as shown in FIG. 1C, if the input signal changed such that the voice signal was stronger or of higher amplitude than the noise signal, the relationship of the voice signal to the total or composite signal would change, although the total signal would remain the same. For example, the voice plus noise signal level or line 30, shown in FIG. 1C, is located on the amplitude axis 32 at a position equal to the position of the voice plus noise signal 24 shown in FIG. 1B, because of the constant amplitude action of the AGC circuit. However, the voice signal 32 is now larger than the noise signal 34. Axis 36 still corresponds to time, where the time frame of FIG. 1C is different than the time frame of FIG. 1B since the separate noise and voice signals have changed. Therefore, even though the total voice plus noise signal level remains the same, the separate voice and noise signal levels have changed with respect to each other even at the output of the AGC.

The result of this type of AGC action, if used without the present invention, is that the voice signal amplitude will appear to fluctuate and change depending upon the amount of noise contained along with the voice signal. Thus, the processed voice signal is not a true representation of the level of the voice signal originally applied to the AGC circuit. In effect, the voice signal level has a tendency to inversely follow the noise signal level such that an increase in noise of the signal applied to the AGC circuit produces a decrease of the speech signal provided to the speech enhancement system.

Figure 2:
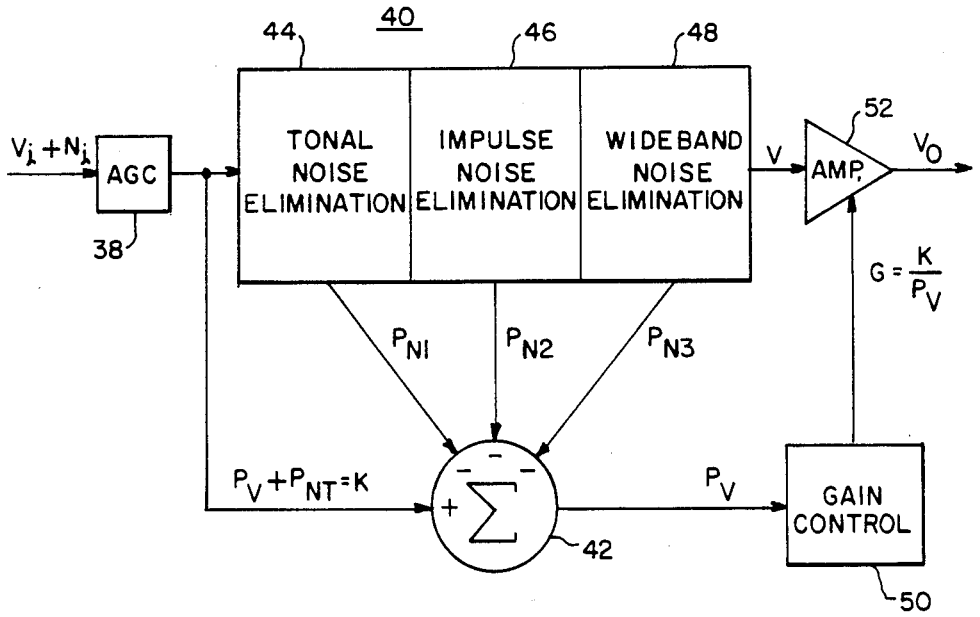
FIG. 2 is a block diagram illustrating a circuit arrangement for implementing the present invention.

FIG. 2 illustrates an arrangement of components which is suitable for implementing the present invention. The input signal to the AGC circuit 38 includes voice and noise components $V_i$ and $N_i$. After leaving the AGC circuit 38, the composite or total voice plus noise signal has a relatively constant power amplitude K and is applied both to the speech enhancement processor 40 and to the summation circuit 42. The composite total noise and voice signal is then processed in the speech enhancement processor 40 by circuits or processes which remove certain types of noise from the signal.

Processor section 44 is used to remove tonal noise from the speech and noise signal. Processor section 46 is used to remove impulse noise from the input signal. Similarly, processor section 48 is used to remove wideband noise from the input signal. All three types of noise elimination processes determine the amount of noise power present in the signal corresponding to the particular type of noise to be removed and provide values or signals corresponding to these power levels. Noise power level $P_{N1}$ is furnished by the processor section 44, noise power level $P_{N2}$ is furnished by the processor section 46, and noise power level $P_{N3}$ is furnished by the processor section 48. Each of the power levels represents the power of the noise signal extracted by the particular elimination process.

The particular arrangement used for eliminating the noise from the signal is not critical to this invention. Details of a system which functions according to the processor 40 shown in FIG. 2 is disclosed in Technical Report RADC-TR-83-109, "Computerized Audio Processor," Rome Air Development Center, May 1983. In that report, the three noise elimination processes are identified and described, with processing section 44 of FIG. 2 corresponding to the DSS processing tecnique, section 46 corresponding to the IMP technique, and section 48 corresponding to the INTEL technique. It is emphasized that other speech enhancement processing techniques may be used with the present invention as long as they provide a noise power signal or value dependent upon the noise to be extracted by the processing technique.

The three noise power levels, together with the constant power level of the combined voice and noise signals, are applied to the summation circuit 42. The extracted noise values are applied to negative inputs so that they are effectively subtracted from the constant signal which is applied to a positive input. The resulting signal, $P_V$, is a gain control signal or value which is applied to the gain control circuit 50 for the purpose of controlling the gain of the amplifier 52. The processed speech or voice signal, V, is applied to the input of the amplifier 52 and the output voice signal, $V_O$, has an amplitude response closely matching, in most typical situations, the desired amplitude of the output of the AGC circuit 38.

The gain control circuit 50 interfaces the gain control signal, $P_V$, to the amplifier 52 in such a manner that the gain of amplifier 52 varies inversely with the value of the gain control signal. Therefore, a gain, G, is established for the amplifier 52 which is equal to K divided by $P_V$, where K is a constant and $P_V$ is the gain control signal.

The signals or values representing the power noise eliminated by the enhancement process are short-term averaged values occurring rapidly during the speech enhancement process. As contrasted with typical AGC delay times, the extracted noise levels provide an almost instantaneous variation in the gain of the amplifier 52 to preserve the original amplitude characteristics of the voice signal. By using this invention, processed speech is more characteristic of the input speech and easier to understand and sounds better than processed speech in which the amplitude of the voice signal varies according to the AGC action.

It is emphasized that numerous changes may be made in the above described system without departing from the teachings of the invention. It is intended that all of the matter contained in the foregoing description, or shown in the accompanying drawing, shall be interpreted as illustrative rather than limiting.

We claim:

1. A speech enhancement system having dynamic gain control, said system comprising:

means for providing a constant amplitude composite speech and noise signal from an applied variable amplitude composite speech and noise signal;

means for processing said constant amplitude composite signal, said processing means performing one or more processes for extracting noise power from said constant amplitude composite signal, thereby providing one or more extracted noise power values and a processed speech output;

means for subtracting all of said noise power values from said constant amplitude composite signal to provide a gain control signal value;

multiplying means for amplifying said processed speech output by a variable ratio; and means for controlling the variable ratio of said multiplying means, with the controlling being dependent upon said gain control signal value.

2. The speech enhancement system of claim 1 wherein the controlling means varies the ratio of the multiplying means inversely with respect to the gain control signal value.

3. The speech enhancement system of claim 1 wherein the controlling means maintains the ratio of the multiplying means equal to a constant divided by the gain control signal value.

4. The speech enhancement system of claim 1 wherein one of the processes for extracting noise power provides noise power values corresponding to the power of tonal noises extracted from the constant amplitude composite signal.

5. The speech enhancement system of claim 1 wherein one of the processes for extracting noise power provides noise power values corresponding to the power of impulse noises extracted from the constant amplitude composite signal.

6. The speech enhancement system of claim 1 wherein one of the processes for extracting noise power provides noise power values corresponding to the power of wideband noises extracted from the constant amplitude composite signal.

7. A speech enhancement system having dynamic gain control, said system comprising:

an automatic gain control means for providing a constant amplitude composite speech and noise signal from an applied variable amplitude composite speech and noise signal;

means for digitally processing said constant amplitude composite signal, said processing means being capable of extracting tonal, impulse, and wideband noise powers from said constant amplitude composite signal, thereby providing three instantaneous extracted noise power values and a processed speech output;

means for subtracting all three of said noise power values from said constant amplitude composite signal to provide a gain control signal value;

multiplying means for amplifying said processed speech output by a variable ratio; and means for maintaining the amplifying ratio of said multiplying means equal to a constant divided by said gain control signal value.

8. A method of speech enhancement having dynamic gain control, said method comprising the steps of:

maintaining constant the level of a composite speech and voice signal;

extracting noise power from said constant level composite signal to provide at least one instantaneous noise power signal value and a processed speech output;

subtracting said noise power signal values from the constant level composite signal to provide a gain control signal;

multiplying said processed speech output by a variable amount; and controlling the variable multiplying amount with the gain control signal.

9. The method of speech enhancement of claim 8 wherein the variable multiplying amount is controlled sufficiently to maintain the amount equal to a constant divided by the gain control signal.

10. The method of speech enhancement of claim 8 wherein said one noise power signal value corresponds to extracted tonal noises.

11. The method of speech enhancement of claim 8 wherein the one noise power signal value corresponds to extracted impulse noises.

12. The method of speech enhancement of claim 8 wherein the one noise power signal value corresponds to extracted wideband noises.

* * * * *